US006506173B2

(12) United States Patent
Gordon

(10) Patent No.: US 6,506,173 B2
(45) Date of Patent: Jan. 14, 2003

(54) PRESSURE POINT FOOT PAD

(76) Inventor: Sharon E. Gordon, 7738 14th Ave., Burnaby (CA), V3N 2A9

( * ) Notice: Subject to any disclaimer, the term of this patent is extended or adjusted under 35 U.S.C. 154(b) by 0 days.

(21) Appl. No.: 09/828,176

(22) Filed: Apr. 9, 2001

(65) Prior Publication Data

US 2002/0147417 A1 Oct. 10, 2002

(51) Int. Cl.[7] ..... A61H 7/00
(52) U.S. Cl. ..... 601/134; 601/136; 601/28
(58) Field of Search ..... 601/84, 134, 138, 601/136, 28; D24/213, 200

(56) References Cited

U.S. PATENT DOCUMENTS

| | | | | | |
|---|---|---|---|---|---|
| 1,954,940 | A | * | 4/1934 | Mikel | 15/110 |
| 1,981,379 | A | * | 11/1934 | Thomson | 606/237 |
| 3,885,555 | A | | 5/1975 | Nobbs | 128/25 B |
| 4,329,981 | A | | 5/1982 | Dungl | 128/25 B |
| 4,694,831 | A | * | 9/1987 | Seltzer | 15/227 |
| 4,852,553 | A | * | 8/1989 | Voykin | 36/140 |
| 5,158,073 | A | | 10/1992 | Bukowski | 128/25 B |
| 5,322,056 | A | * | 6/1994 | Menghi et al. | 36/11.5 |
| 5,716,331 | A | * | 2/1998 | Chang | 601/28 |
| 5,899,868 | A | * | 5/1999 | VandeBerg | 601/134 |
| 6,171,269 | B1 | * | 1/2001 | Norin | 132/75.6 |
| 6,210,349 | B1 | * | 4/2001 | Naruse et al. | 601/122 |

* cited by examiner

*Primary Examiner*—Nicholas D. Lucchesi
*Assistant Examiner*—Quang D Thanh
(74) *Attorney, Agent, or Firm*—Bull, Housser & Tupper

(57) ABSTRACT

The purpose of my invention of the foot massaging pad is massaging pressure point device. When used on a standard enamel, acrylic plastic fiberglass and heavy porcelain tub a person massaging their pressure points may sit comfortably in a warm bath placing their feet either the left foot or right foot or both which has pressure points distributed over substantially entire front of the pad. The foot massaging pad's holding means are in the form of integral suction cups formed on the back face to maintain the position of the device in use. My invention can be placed and removed after each use.

3 Claims, 1 Drawing Sheet

PRESSURE POINT FOOT PAD

BACKGROUND OF THE INVENTION

The flexible foot massaging pads so far designed do not offer the possibility to massage a particular portion of the foot. Those pads comprise protuberances randomly located on the top portion of the pad.

SUMMARY OF THE INVENTION

It is therefore proposed to have a flexible massaging pad comprising pressure points for massaging a foot or the feet of a user. The pressure points are located in specific zones of the foot to massage one or several zones of the foot at a time.

DESCRIPTION OF THE INVENTION

The flexible foot massaging pad is made of a flexible water resistant material like rubber and comprises a pressure point zone 2, 3 having the shape of a left and right foot print. The water resistant material can be rubber mold formed. The foot prints can be made of a second layer of rubber affixed to the pad.

Raised pressure points 8 are specifically located within each of the foot prints 2, 3 to correspond to a particular portion of the foot to be massage. Pressure points 8 are located in zones corresponding to each of the toes of the user. Three pressure points 8 are grouped to form a convex transversal line in the front portion of each foot print. Two pressure points 8 are also located on a transversal line in the middle portion of each foot print. Finally, three pressure points 8 are grouped on a longitudinal line in the rear portion of each foot print.

The pad can be used either horizontally where the user stands on it and massages his/her foot/feet. Or the pad can be used in the bath affixed to a vertical support such as the bath wall near the tab. To that effect, a drainage groove 7 can be made in the pad such that it surrounds the lower portion of the safety drainage hole located beneath the tab. To affix the pad to vertical wall, suction cups 6 can be used as shown on FIG. 1.

A pad portion 4 can be provided for printing the foot pad title.

The foot pad may be formed as a mold of uniform thickness in the order of one to two inches thick, or may alternatively be formed with a thinner bottom portion and thicker upper walls and upper edge to better cushion any impact of the bather.

Figure 1:
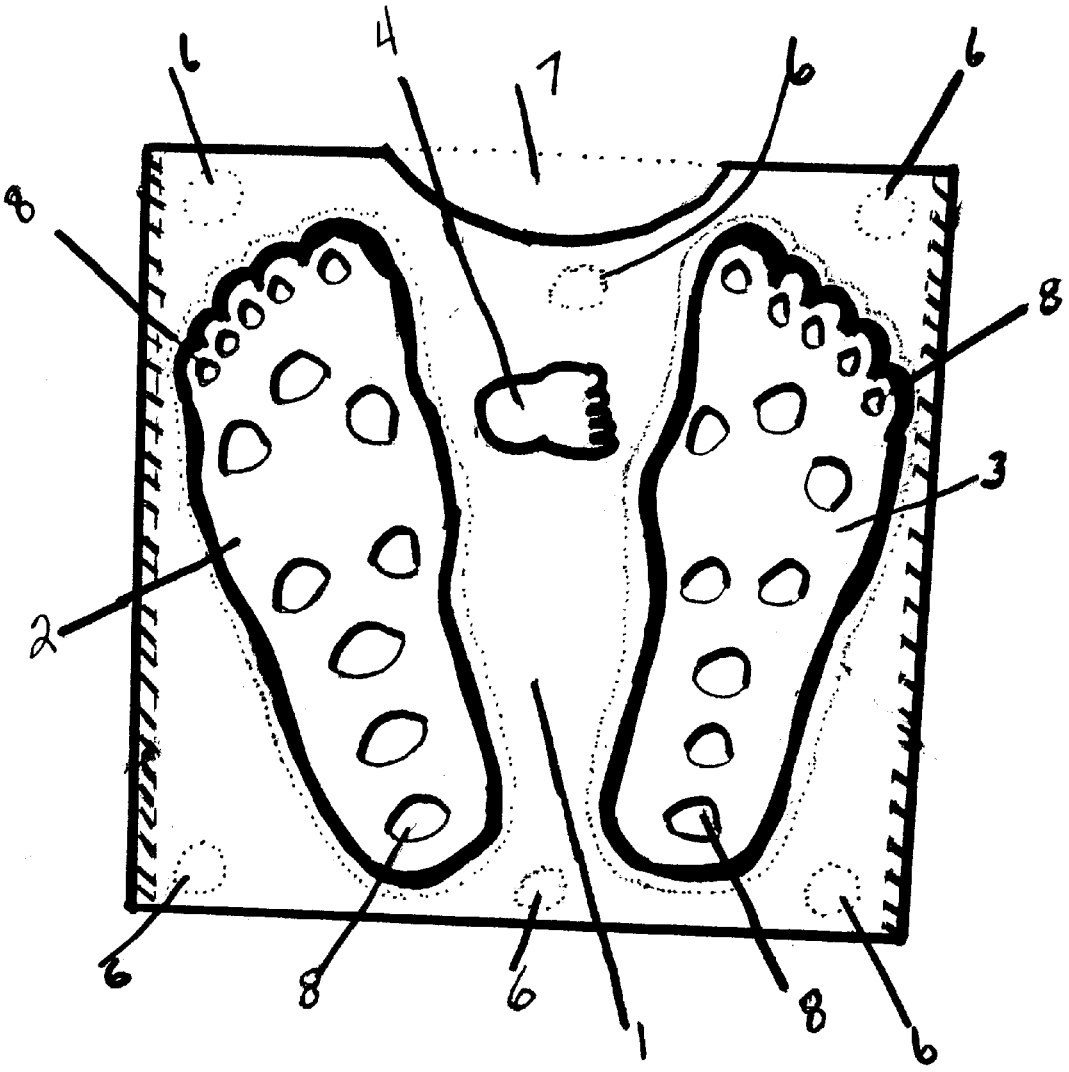
FIG. 1 shows a plan view of the pad with the distribution of the pressure points.

What I claim as my invention is:

1. A pressure point foot pad for massaging the feet of a user comprising:

(a) a flexible water resistant pad with a pressure point zone having a shape of left and right foot print, each foot print having a front, a middle and a rear portion, and the pad having a top, bottom, left, right, front and back side;

(b) raised pressure points specifically located within each of the foot prints so as to correspond to a particular portion of the foot to be massaged, the pressure points being located only as follows: a pressure point sized and configured to each of the underneath portion of the toes, three pressure points grouped to form a convex transversal line in the front portion, two pressure points located on a transversal line in the middle portion, and three pressure points grouped on a longitudinal line in the rear portion;

(c) the pressure point foot pad further comprising a groove in the middle of the top side adapted to surround a lower portion of a bath safety water overflow drainage hole when fixable on a safety water overflow drainage hole wall, or to surround a portion of a bath drainage hole when fixable horizontally on a bottom of the bath.

2. The pressure point foot pad as in claim 1 further comprising suction cups secured to the back side in order to fix the pad to a support surface.

3. The pressure point foot pad as in claim 1 wherein the foot prints constitute an additional layer of water resistance material affixed to the flexible water resistant pad.

* * * * *